US010821744B2

(12) United States Patent
Akuta et al.

(10) Patent No.: US 10,821,744 B2
(45) Date of Patent: Nov. 3, 2020

(54) MEDIUM WIND-UP DEVICE, PRINTING MACHINE, AND MEDIUM WIND-UP METHOD

(71) Applicant: MIMAKI ENGINEERING CO., LTD., Nagano (JP)

(72) Inventors: Shunsuke Akuta, Nagano (JP); Tomohiro Takano, Nagano (JP); Kosaku Hotta, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 16/292,333

(22) Filed: Mar. 5, 2019

(65) Prior Publication Data

US 2019/0275814 A1 Sep. 12, 2019

(30) Foreign Application Priority Data

Mar. 8, 2018 (JP) ..... 2018-041988

(51) Int. Cl.

| | |
|---|---|
| ***B41J 11/00*** | (2006.01) |
| ***B41J 15/16*** | (2006.01) |
| ***B41J 15/04*** | (2006.01) |
| ***B41J 15/02*** | (2006.01) |
| ***B65H 23/00*** | (2006.01) |

(52) U.S. Cl.

CPC ..... *B41J 11/0005* (2013.01); *B41J 15/02* (2013.01); *B41J 15/046* (2013.01); *B41J 15/165* (2013.01); *B65H 23/00* (2013.01)

(58) Field of Classification Search

CPC ..... B41J 11/0005; B41J 15/02; B41J 15/046; B41J 15/165; B65H 23/00

See application file for complete search history.

(56) References Cited

U.S. PATENT DOCUMENTS

2013/0278666 A1* 10/2013 Hori ..... B41J 15/16 347/16

FOREIGN PATENT DOCUMENTS

| | | | |
|---|---|---|---|
| JP | 2013086422 | | 5/2013 |
| JP | 2014024643 A | * | 2/2014 |

* cited by examiner

*Primary Examiner* — Henok D Legesse
(74) *Attorney, Agent, or Firm* — JCIPRNET

(57) ABSTRACT

A medium wind-up device is provided to suppress causing a wrinkle at a time of winding a medium, and also suppress a fluctuation of a winding position. The medium wind-up device includes: a tension roller that presses a medium, which is belt-shaped and transferred in a transfer direction that is predetermined, in order to provide the medium with a tension; a reversing roller that reverses the medium pressed by the tension roller, and the reversing roller being rotatable so as to follow a move of the medium; a loading mechanism that is capable of placing a load against a rotation of the reversing roller; and a wind-up portion that winds up the medium reversed by the reversing roller.

12 Claims, 8 Drawing Sheets

MEDIUM WIND-UP DEVICE, PRINTING MACHINE, AND MEDIUM WIND-UP METHOD

CROSS REFERENCE TO RELATED APPLICATIONS

This application claims the priority benefit of Japanese Patent Application No. 2018-041988, filed on Mar. 8, 2018. The entirety of the above-mentioned patent application is hereby incorporated by reference herein and made a part of this specification.

TECHNICAL FIELD

The present disclosure relates to a medium wind-up device, a printing machine, and a medium wind-up method.

BACKGROUND ART

In a printing machine that creates an image and the like while feeding a medium, wound up so as to be a roll, such as paper and so on, there is provided a wind-up device that winds up the medium after creating the image (for example, refer to Patent Document 1).

Patent Document 1: Japanese Unexamined Patent Application Publication No. 2013-86422

In a wind-up device, such as described in Patent Document 1; a tension provided to the medium is controlled by use of a tension roller and the like, in the case where a medium transfer distance becomes long.

At the time, if the tension provided to the medium is excessively high, the medium contracts in a width-wise direction owing to the tension so that sometimes a wrinkle is caused at a wind-up portion. On the other hand, if the tension provided to the medium is excessively low, a winding position in a wind-up portion fluctuates in the width-wise direction, in such a way that sometimes a part of an end face in the width-wise direction protrudes in a state where the medium has been wound up. Therefore, it is requested to suppress causing the wrinkle at a time of winding the medium, and also suppress a fluctuation of the winding position.

SUMMARY

With the issue described above being taken into consideration, the present disclosure provides a medium wind-up device, a printing machine, and a medium wind-up method, with which it is possible to suppress causing a wrinkle at the time of winding a medium, and also suppress the fluctuation of the winding position.

A medium wind-up device according to the present disclosure includes: a tension roller, configured to press a medium, which is belt-shaped and transferred in a transfer direction that is predetermined, in order to provide the medium with a tension; a reversing roller, configured to reverse the medium pressed by the tension roller, and the reversing roller being rotatable so as to follow a move of the medium; a loading mechanism, configured to be capable of placing a load against a rotation of the reversing roller; and a wind-up portion, configured to wind up the medium reversed by the reversing roller.

According to the present disclosure; by placement of the reversing roller in the transfer path from the tension roller to the wind-up portion, the transfer path can be shortened. If the transfer path from the tension roller to the wind-up portion becomes long, a wrinkle is likely to be caused at a middle part of the medium in the width-wise direction, even in the case of the same tension being provided. On the other hand, even though the reversing roller is placed in the transfer path from the tension roller to the wind-up portion; if the reversing roller rotates while following the move of the medium without having a load placed, a wrinkle is likely to be caused in the same manner at a middle part of the medium in the width-wise direction. In the meantime, according to the present disclosure; a load can be placed against a rotation of the reversing roller by the loading mechanism. By way of placement of a load against a rotation of the reversing roller, a load is placed for transferring the medium so that causing a wrinkle is suppressed in advance. Moreover, a stronger tension can be provided to the medium in such a way that a fluctuation of the winding position can be suppressed.

In the medium wind-up device described above, the loading mechanism may be configured to be able to stop a rotation of the reversing roller.

According to this configuration, contraction of the medium in the width-wise direction can more certainly be suppressed, and therefore causing a wrinkle can be suppressed.

In the medium wind-up device described above, a surface of the reversing roller for contacting the medium is made to be smooth by using a metal material.

According to this configuration, while causing a wrinkle in the medium is suppressed, the medium can smoothly be transferred.

The medium wind-up device described above may further include: an upstream-side reversing roller, configured to reverse the medium at an upstream side in the transfer direction in relation to the tension roller, in order to have a winding angle of the medium to be wound around the tension roller, within a predetermined angle range.

According to this configuration, the winding angle with respect to the tension roller can be made within the predetermined angle range, between the upstream-side reversing roller and the reversing roller, in such a way that complicating the transfer path of the medium can be suppressed.

A printing machine according to the present disclosure includes: an image forming device, configured to create an image on a medium, and being belt-shaped and transferred in a transfer direction that is predetermined; and the medium wind-up device described above, in order to wind up the medium on which the image has been created.

According to the present disclosure; at a time of winding up the medium after creating the image, causing a wrinkle can be suppressed, and the fluctuation of the winding position can be suppressed so that a high-quality printed material can be created.

In the printing machine described above, the image forming device may be configured to make an adjustment with respect to positions for creating the images, in such a way that the images are located evenly in a width-wise direction being perpendicular to the transfer direction of the medium, in a state of having been wound up by the medium wind-up device.

According to this configuration, by making use of thickness of the images to be created on the medium, it becomes possible to make the thickness of the medium becomes even in the width-wise direction, in the state of the medium having been wound up.

A medium wind-up method according to the present disclosure includes: pressing a medium, which is belt-shaped and transferred in a transfer direction that is predetermined, by use of a tension roller, in order to provide the medium with a tension; reversing the medium, which is pressed by the tension roller, by use of a reversing roller, in a state where a load is placed against a rotation of the reversing roller that is rotatable so as to follow a move of the medium; and winding up the medium reversed by the reversing roller.

According to the present disclosure; by placement of the reversing roller in the transfer path from the tension roller to the wind-up portion, the transfer path can be shortened. Furthermore, by means of placement of a load against a rotation of the reversing roller by the loading mechanism, a load is placed for transferring the medium so that causing a wrinkle is suppressed in advance. Moreover, a stronger tension can be provided to the medium in such a way that a fluctuation of the winding position can be suppressed.

According to the present disclosure, it is possible to provide a medium wind-up device, a printing machine, and a medium wind-up method, with which it is possible to suppress causing a wrinkle at a time of winding a medium, and also suppress a fluctuation of a winding position.

DESCRIPTION OF EMBODIMENTS

An embodiment of a medium wind-up device, a printing machine, and a medium wind-up method according to the present disclosure is explained below with reference to the drawings. Incidentally, the present embodiment does not place any restriction on a scope of the present disclosure. Moreover, a constituent element in the embodiment described below includes any element with which a person skilled in the art can easily replace, and any element that is substantially the same as described below.

Figure 1:
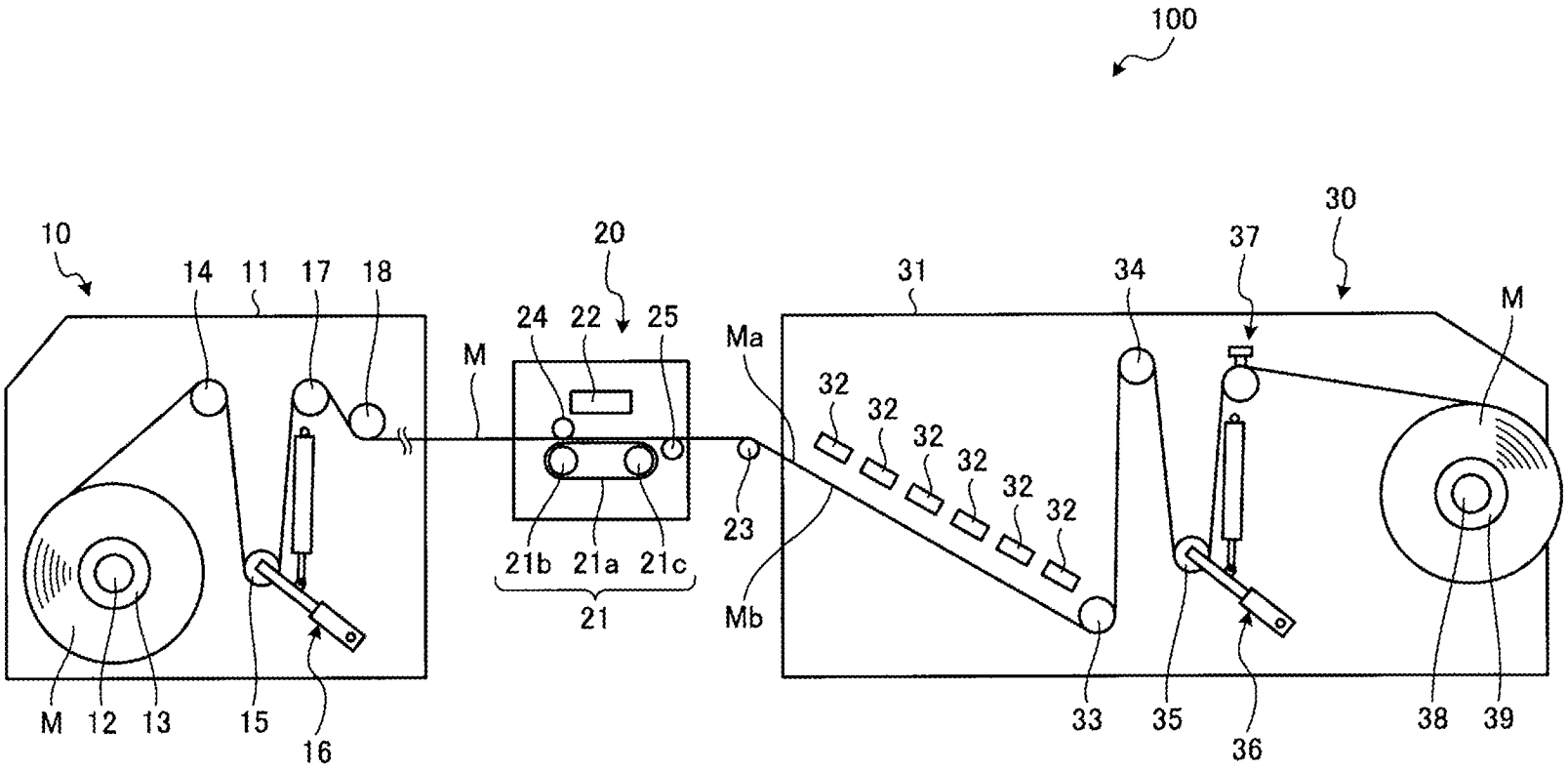
FIG. 1 is a diagram that schematically shows an example of a printing machine according to a present embodiment.

FIG. 1 is a diagram that schematically shows an example of a printing machine 100 according to the present embodiment. The printing machine 100 shown in FIG. 1 transfers a medium M, being belt-shaped, and creates an image including a character, a figure, and the like; on a first surface Ma as an image forming surface of the medium M. Even though in a cited case, for example, a cloth is used as the medium M in the present embodiment; the medium M is not limited to a cloth, and any other kind of media, such as paper, a resin film, and the like may be used. As shown in FIG. 1, the printing machine 100 is provided with a feeding device 10, an image forming device 20, and a wind-up device (a medium wind-up device) 30.

The feeding device 10 feeds the medium M, which is wound up as a roll, to the image forming device 20. The feeding device 10 includes a frame 11, a rotating driver 12, a feeding roller 13, a guide roller 14, a tension roller 15, a tension adjusting mechanism 16, and guide rollers 17 and 18. The rotating driver 12 has, for example, a drive source, such as a motor and the like so as to rotate the feeding roller 13. While the medium M being wound up as a roll, the feeding roller 13 rotates by use of a drive power of the rotating driver 12 in such a way as to feed the medium M. The guide roller 14 reverses the medium M fed from the feeding roller 13. The tension roller 15 provides a tension to the medium M reversed by the guide roller 14. The tension adjusting mechanism 16 adjusts the tension provided from the tension roller 15 to the medium M. The guide rollers 17 and 18 externally send the medium M, which is reversed by the tension roller 15, out of the feeding device 10.

The image forming device 20 creates an image on the first surface Ma of the medium M fed out of the feeding device 10, and sends the medium M to the wind-up device 30. The image forming device 20 includes a medium transfer mechanism 21, a jetting head 22, an introducing roller 23, a medium pressing roller 24, and a medium peeling roller 25. Meanwhile, the medium transfer mechanism 21 has a belt part 21*a*, and belt drive rollers 21*b* and 21*c*. The belt part 21*a* is able to circulate in a clockwise direction in FIG. 1. The belt part 21*a* supports a second surface Mb that is positioned at an opposite side to the first surface Ma, where an image is created, in the medium M. On an outside surface of the belt part 21*a*, there is formed, for example, an adhesive material and the like, in order to attach the medium M. By way of the belt drive rollers 21*b* and 21*c* circulating the belt part 21*a*, the medium transfer mechanism 21 supports and transfers the medium M in a transfer direction, in the image forming device 20. The medium pressing roller 24 presses the medium M against the belt part 21*a*. The medium peeling roller 25 peels the medium M, transferred to a downstream side of the image forming device 20, from the belt part 21*a*. Meanwhile, the introducing roller 23 introduces the medium M into the wind-up device 30.

The jetting head 22 is held, for example, by a carriage that is not illustrated; and provided in such a way as to be movable in a reciprocating manner in a scanning direction that is perpendicular to the transfer direction of the medium M. The jetting head 22 jets ink for creating an image, to the first surface Ma of the medium M from a nozzle that is not illustrated. By means of jetting the ink to the first surface Ma of the medium M, the jetting head 22 creates an image on the first surface Ma of the medium M. In the jetting head 22; for example, such nozzles are arranged along the transfer direction of the medium M. Incidentally, a configuration of the jetting head 22 is not limited to what is described above.

Figure 2:
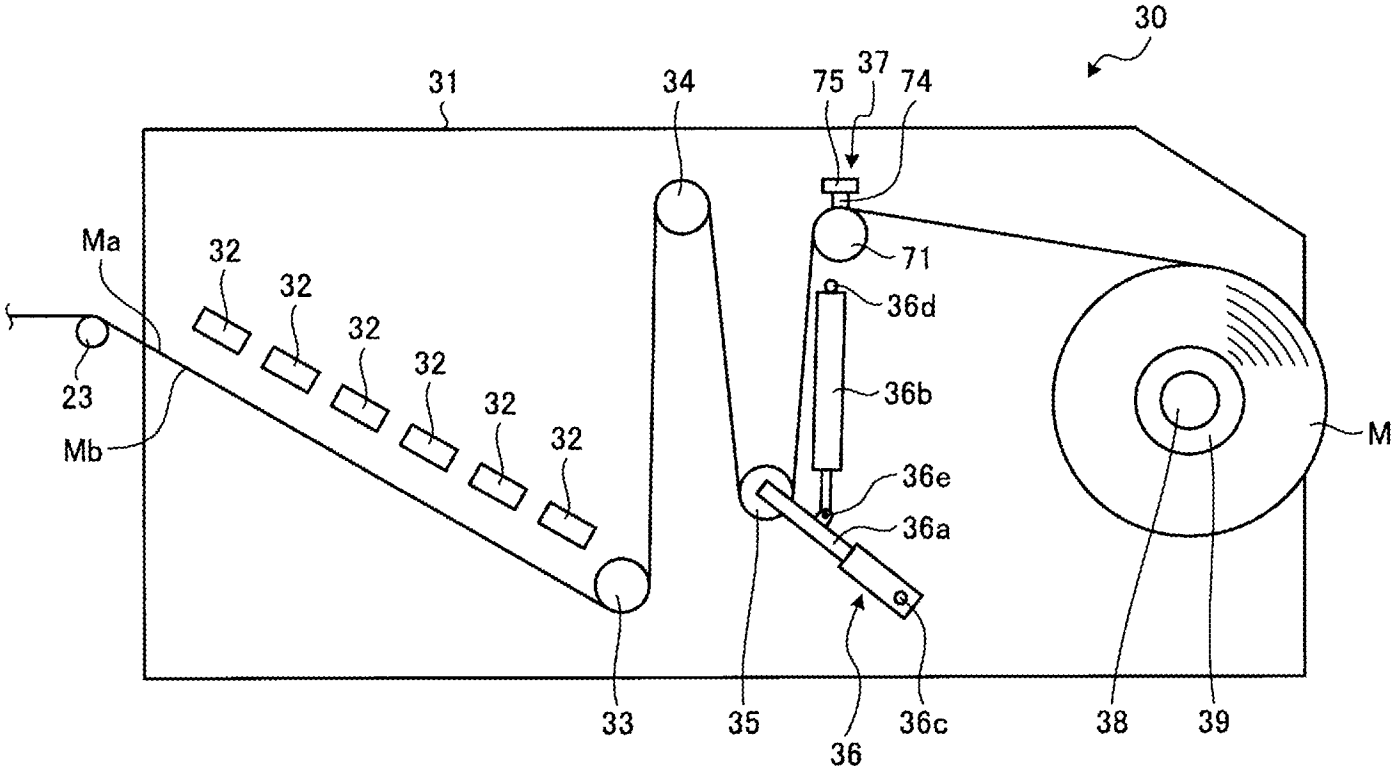
FIG. 2 is a diagram that shows an example of a medium wind-up device.

The wind-up device 30 winds up the medium M transferred from the image forming device 20, after creating an image. FIG. 2 is a diagram that shows an example of the medium wind-up device 30. As shown in FIG. 2, the wind-up device 30 has a frame 31, a heater 32, a relay roller 33, an upstream-side reversing roller 34, a tension roller 35, a tension adjusting mechanism 36, a reversing roller 37, a rotating driver 38, and a wind-up roller (a wind-up portion) 39.

The heater 32 heats up the ink discharged onto the first surface Ma of the medium M, for drying the ink so as to fix the ink onto the medium M. The heater 32 is placed, for example, in plurality along the transfer direction of the medium M. The relay roller 33 contacts the first surface Ma of the medium M so as to send the medium M, heated up by the heater 32, to the upstream-side reversing roller 34. The relay roller 33 is a follower roller that rotates in such a way as to follow a move of the medium M in the transfer direction. Since the image created on the first surface Ma of the medium M is already fixed by use of the heater 32, a state of the image can be maintained at a time of reversing the medium M by the relay roller 33.

The upstream-side reversing roller 34 is located at an upper side in the diagram, in relation to the relay roller 33. The upstream-side reversing roller 34 contacts the second surface Mb so as to reverse the medium M downward, wherein the second surface Mb being a back side of the first surface Ma of the medium M. The upstream-side reversing roller 34 is a follower roller that rotates in such a way as to follow a move of the medium M in the transfer direction.

The tension roller 35 presses the first surface Ma of the medium M, which is reversed by the upstream-side reversing roller 34, in order to provide a tension to the medium M. The tension roller 35 is a follower roller that rotates in such a way as to follow a move of the medium M in the transfer direction. The tension roller 35 is placed in such a way as to be shift-able by means of the tension adjusting mechanism 36.

The tension adjusting mechanism 36 adjusts the tension provided to the medium M, by way of displacement of the tension roller 35. The tension adjusting mechanism 36 has a tension bar 36*a* and an air-cylinder mechanism 36*b*. One end of the tension bar 36*a* is connected to the tension roller 35, and the other end of the tension bar 36*a* is connected to a shaft part 36*c*. The tension bar 36*a* can turn around the shaft part 36*c*, as a turning center, by means of the air-cylinder mechanism 36*b*. While the tension bar 36*a* turns around the shaft part 36*c*, as a turning center, the tension roller 35 is displaced. One end (for example, an upper side end) of the air-cylinder mechanism 36*b* is supported by a shaft part 36*d*, and meanwhile the other end (for example, a lower side end) of the air-cylinder mechanism 36*b* is connected to a connection part 36*e* of the tension bar 36*a*. The air-cylinder mechanism 36*b* activates the tension bar 36*a*.

The reversing roller 37 reverses the medium M, which is pressed by the tension roller 35, toward a side of the wind-up roller 39. As the reversing roller 37; for example, a brake roller is employed. A configuration of the reversing roller 37 is described later. Following a move of the medium M, the reversing roller 37 is rotatable. The reversing roller 37 is located at an upper side of the tension roller 35, and placed side-by-side with the upstream-side reversing roller 34. The reversing roller 37 and the upstream-side reversing roller 34, described above, are so arranged as to have a winding angle of the medium M at the tension roller 35, within a predetermined angle range.

The rotating driver 38 includes a drive source, such as a motor, and the like, in order to rotate the wind-up roller 39. The wind-up roller 39 winds up and holds the medium M as a roll, the medium M being reversed by the reversing roller 37.

Figure 3:
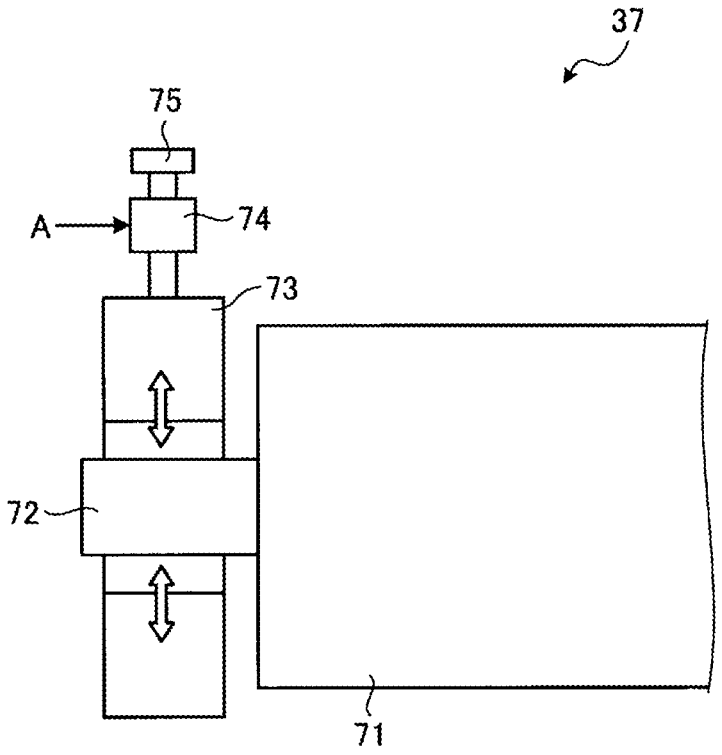
FIG. 3 is a diagram that shows an example of a reversing roller.

FIG. 3 is a diagram that shows an example of the reversing roller 37. As shown in FIG. 3, the reversing roller 37 includes a roller main body 71, a spindle 72, a brake pad 73, an air supplier 74, and an adjusting valve 75. The roller main body 71 is shaped to be cylindrical, and a surface of the roller main body 71 for contacting the medium M is made to be smooth by using a metal material. Incidentally, a material for making up the surface of the roller main body 71 is not limited to a metal material; and a resin material, such as rubber and the like, as well as any other material may be used. Moreover, in the case where the surface of the roller main body 71 is made by use of a metal material, a resin material such as rubber may be placed at least for a part of the surface of the roller main body 71; and still further, the surface of the roller main body 71 may be made to be rough by way of thermal spraying and the like. According to such a configuration, it becomes possible to easily place a load for transferring the medium M.

The spindle 72 is provided together with the roller main body 71, in such a way as to protrude out of both ends a rotating shaft of the roller main body 71. The brake pad 73 is placed at a position surrounding the spindle 72. The brake pad 73 is movable in a radial direction of the rotating shaft in relation to the spindle 72. The brake pad 73 is able to press an outer circumferential surface of the spindle 72, by way of moving toward a side of the spindle 72. Then, the brake pad 73 can place a load against a rotation of the roller main body 71, by way of pressing the outer circumferential surface of the spindle 72.

The air supplier 74 drives the brake pad 73 by way of supplying the brake pad 73 with air A. In the meantime, the adjusting valve 75 adjusts a flow rate of the air A to be supplied to the brake pad 73 from the air supplier 74. By way of adjusting the flow rate of the air A, a pressing force of the brake pad 73 onto the spindle 72 can be adjusted. The adjusting valve 75 can adjust the load against the rotation of the roller main body 71, by way of adjusting the pressing force of the brake pad 73. For example, the adjusting valve 75 can stop the rotation of the roller main body 71, by way of adjusting the pressing force of the brake pad 73. An adjustment of the flow rate of the air A by the adjusting valve 75 may be carried out, for example, by a controller, not illustrated, of the printing machine 100; and it may also be carried out manually by an operator. Thus, the brake pad 73, the air supplier 74, and the adjusting valve 75 make up a loading mechanism that can place a load against a rotation of the reversing roller 37.

Then, operation of the printing machine 100 configured as described above is explained next. Prior to the operation of the printing machine 100, at first the medium M is installed. For example, by way of hand work of an operator, the medium M prepared as a roll is installed onto the feeding roller 13 of the feeding device 10. Then, after an end part is pulled out of the medium M prepared as a roll so as to be placed into a transfer path of the medium M in due order, the end part is entangled in the wind-up roller 39 of the wind-up device 30. Thus, an installation of the medium M finishes, and the medium M becomes ready for transfer operation.

After the medium M becomes ready for transfer operation; if image data of an image to be created on the medium M and an operation start command are input into the printing machine 100, the printing machine 100 turns the feeding roller 13 of the feeding device 10 and the wind-up roller 39 of the wind-up device 30 in order to transfer the medium M. In the meantime, while moving the jetting head 22 of the image forming device 20 in a reciprocating manner in the scanning direction, the printing machine 100 carries out jetting ink onto the medium M. The ink, which has been jet, adheres on the first surface Ma of the medium M. Thus, the image is created with the ink on the first surface Ma of the medium M. Then, the medium M, on which the image has been created, is transferred to the wind-up device 30.

With respect to the medium M transferred to the wind-up device 30, the heater 32 heats up the first surface Ma. Accordingly, the ink is dried by means of heating up so as to fix the image on the first surface Ma. In a state where the image is fixed on the first surface Ma, the medium M is transferred to the relay roller 33. While following a move of the medium M, the relay roller 33 rotates, in a state of contacting the first surface Ma of the medium M. Then, the medium M is reversed by the relay roller 33, and guided to the upstream-side reversing roller 34. The medium M transferred to the upstream-side reversing roller 34 is reversed downward there by the upstream-side reversing roller 34, and then reversed upward by the tension roller 35. The medium M reversed by the tension roller 35 is reversed by the reversing roller 37 toward a side of the wind-up roller 39, and then wound up by the wind-up roller 39.

Figure 4:
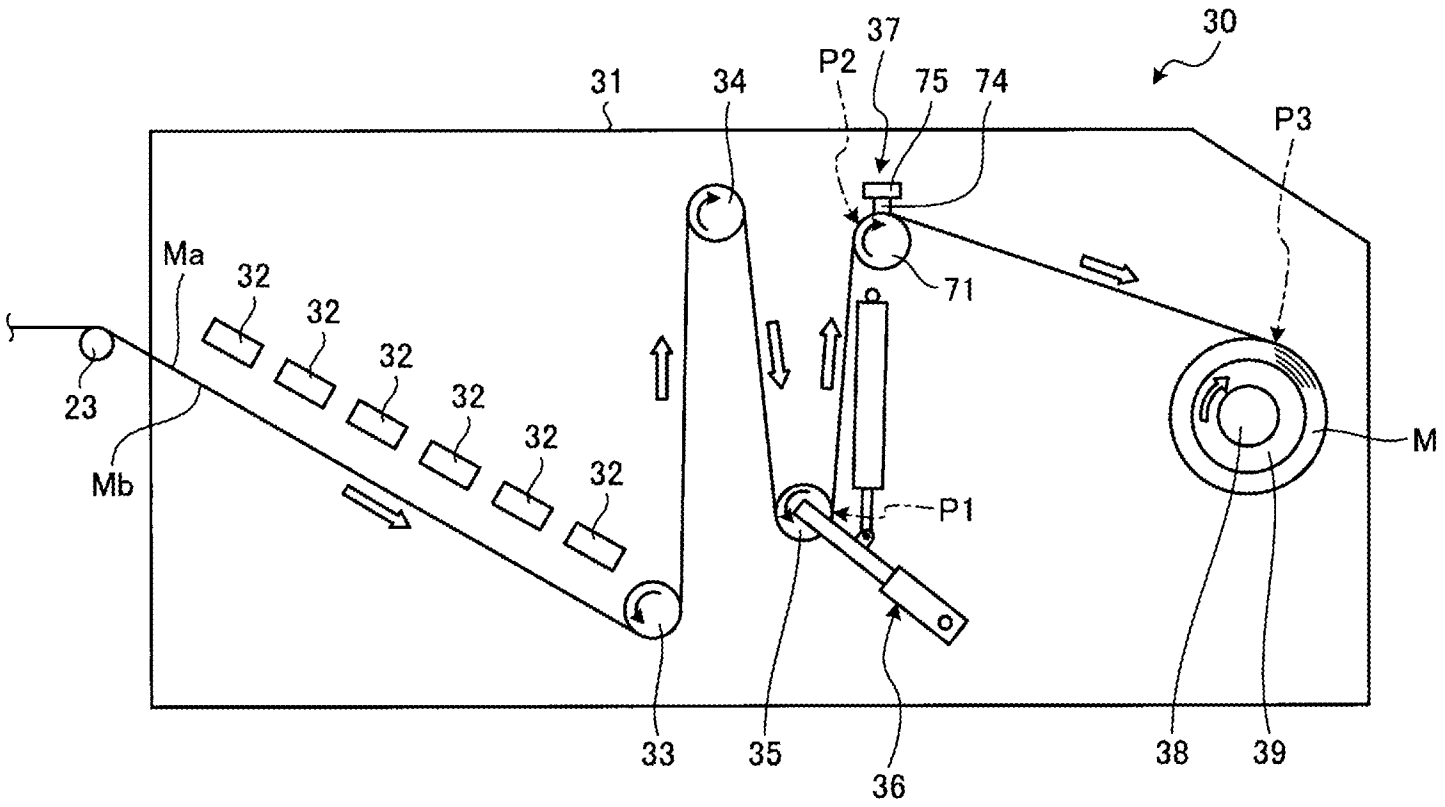
FIG. 4 is a diagram that shows operation of the medium wind-up device.
Figure 5:
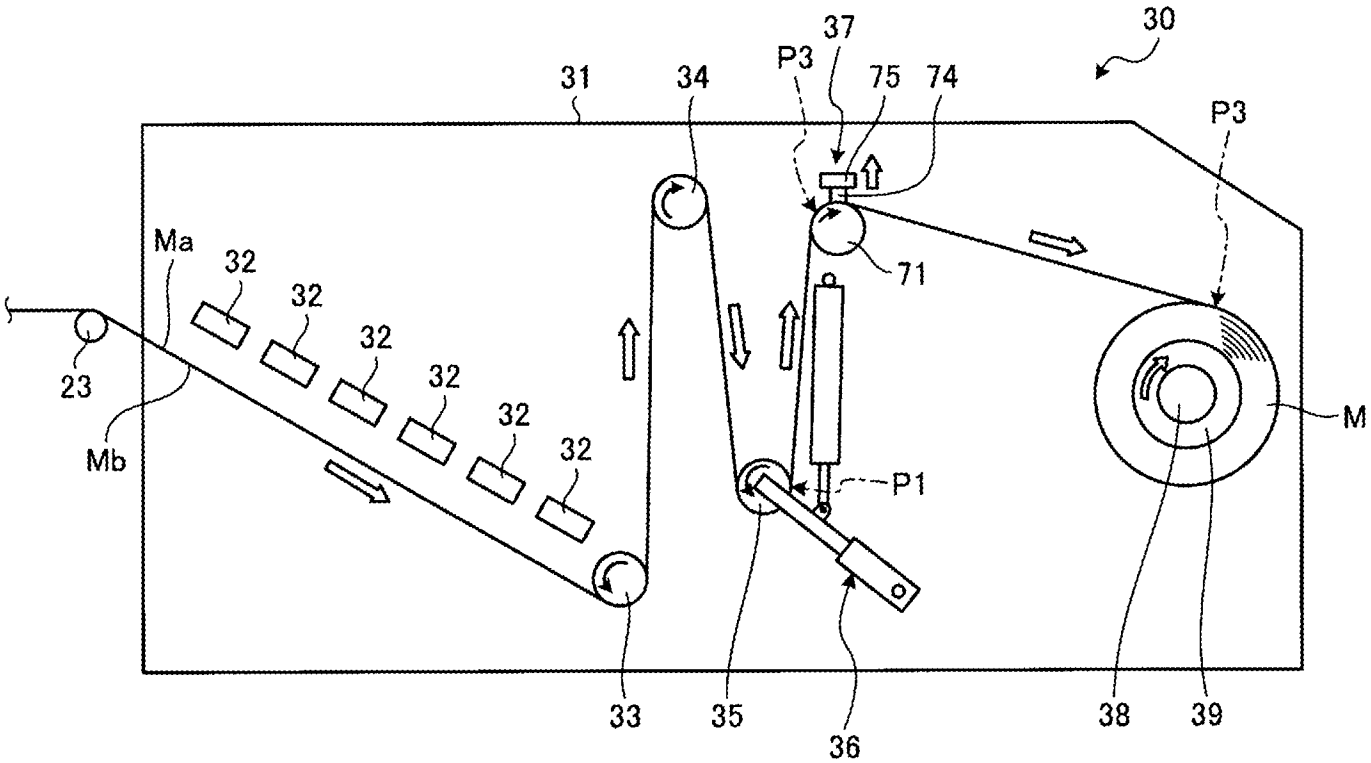
FIG. 5 is another diagram that shows operation of the medium wind-up device.

FIG. 4 and FIG. 5 are diagrams that show operation of the medium wind-up device 30. As shown in FIG. 4, in the case where a wind-up volume at the wind-up roller 39 is less than a predetermined volume, the reversing roller 37 is made so as to rotate, while following a transfer speed. The predetermined volume with respect to the wind-up volume can be determined in accordance with, for example, an experimental value, a simulation value, an actual measurement value, and the like.

Meanwhile, in the case where the wind-up volume at the wind-up roller 39 becomes greater than the predetermined volume; by way of adjusting the adjusting valve 75 of the reversing roller 37 for increasing the flow rate of the air A in order to increase the pressing force of the brake pad 73 (refer to FIG. 3), a load is placed against a rotation of the reversing roller 37, as shown in FIG. 5. An adjustment of the adjusting valve 75 may be carried out, by a controller, not illustrated, of the printing machine 100; and it may manually be carried out as well by an operator. Incidentally, in this case; for example, a rotation of the reversing roller 37 may be stopped by way of an adjustment of the adjusting valve 75. In the case where a load is placed against a rotation of the reversing roller 37, the load can be made, for example, to be constant regardless of a wind-up diameter of the medium M at the wind-up roller 39. Incidentally, a load may be placed against the rotation of the reversing roller 37 from a stage of starting a transfer of the medium M.

Figure 6:
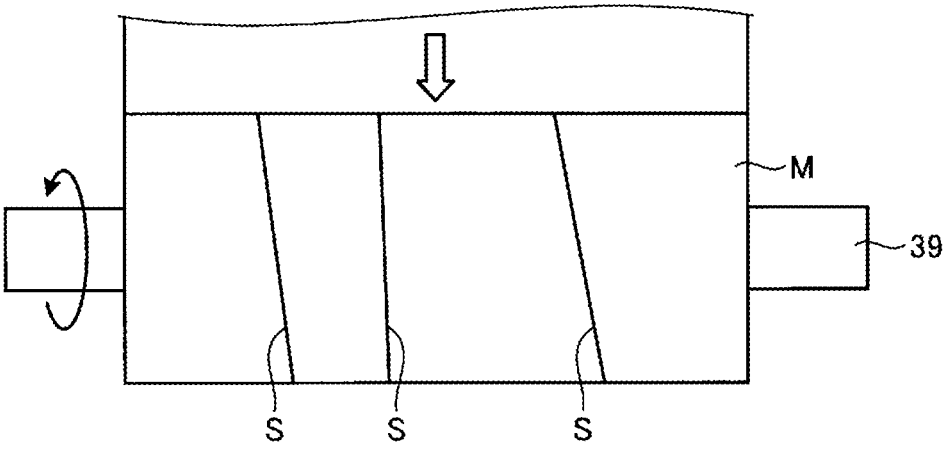
FIG. 6 is a diagram that shows an example of a state of a medium wound up, in accordance with a comparison example.
Figure 7:
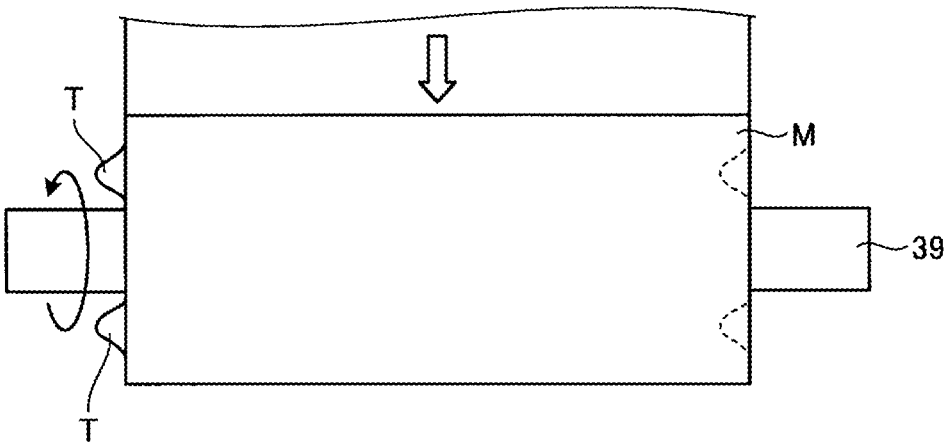
FIG. 7 is a diagram that shows an example of a state of a medium wound up, in accordance with another comparison example.

FIG. 6 and FIG. 7 are diagrams that show examples of a state of the medium M wound up, in accordance with comparison examples. At a time of winding up the medium M; if a tension provided to the medium M is excessively high, the medium M contracts in a width-wise direction owing to the tension in such a way that sometimes a wrinkle S is caused at the wind-up roller 39 as shown in FIG. 6. On the other hand, if the tension provided to the medium M is excessively low, a winding position at the wind-up roller 39 fluctuates in the width-wise direction, in such a way that sometimes a part of an end face in the width-wise direction protrudes so as to form a protrusion T, in a state where the medium M has been wound up, as shown in FIG. 7.

In the meantime, according to the present embodiment; by placement of the reversing roller 37 in the transfer path of the medium M from the tension roller 35 to the wind-up roller 39, for example, in a process of winding up the medium M, the transfer path can be shortened as shown in FIG. 5. If the transfer path from the tension roller 35 to the wind-up roller 39 becomes long, a wrinkle is likely to be caused at a middle part of the medium M in the width-wise direction, even in the case of the same tension being provided. On the other hand, even though the reversing roller 37 is placed in the transfer path from the tension roller 35 to the wind-up roller 39; if the reversing roller 37 rotates while following the move of the medium M without having a load placed, a wrinkle is likely to be caused in the same manner at a middle part of the medium M in the width-wise direction. In the meantime, according to the present disclosure; a load can be placed against a rotation of the reversing roller 37 by the loading mechanism (including the brake pad 73, the air supplier 74, and the adjusting valve 75). By way of placement of a load against a rotation of the reversing roller 37, the load is placed for transferring the medium M so that causing a wrinkle is suppressed in advance. Moreover, a stronger tension can be provided to the medium M in such a way that a fluctuation of the winding position can be suppressed.

Figure 8:
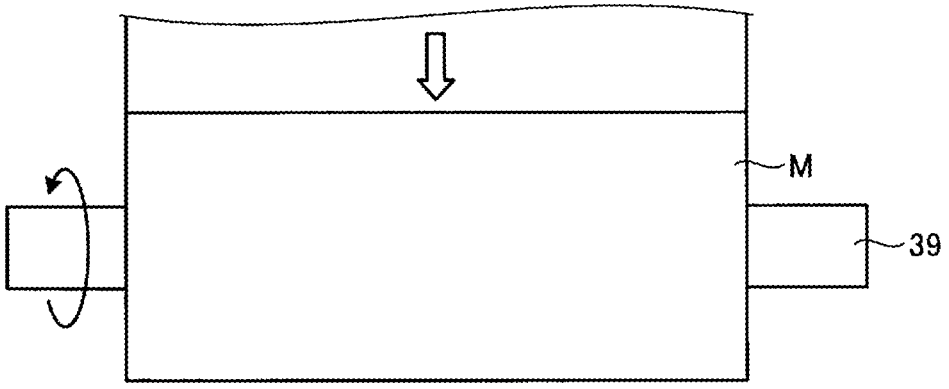
FIG. 8 is a diagram that shows an example of a state of a medium wound up, according to the present embodiment.

FIG. 8 is a diagram that shows an example of a state of the medium M wound up, according to the present embodiment. A distance, for which the tension is provided in the transfer direction of the medium M, is partitioned so that contraction of the medium M in the width-wise direction can be suppressed even if the tension by the tension roller 35 is strengthened. Thus, causing a wrinkle at a time of winding up medium M can be suppressed, as shown in FIG. 8.

Furthermore, at the time of winding up medium M; the greater the diameter of the medium M wound up becomes, the greater the tension needed for suppressing the fluctuation of the winding position in the width-wise direction becomes. Fortunately, according to the configuration of the present embodiment, a higher tension can be provided to the medium M; and therefore, the fluctuation of the winding position at the wind-up roller 39 can be suppressed even at a time when the diameter of the medium M wound up becomes greater. Accordingly, it is possible to suppress a partial protrusion of the end face in the width-wise direction, in a state where the medium M has been wound up, as shown in FIG. 8.

Incidentally, in the case where the wind-up volume at the wind-up roller 39 becomes greater than the predetermined volume, for example, the rotation of the reversing roller 37 may be stopped. In this case, since the medium M passes by the reversing roller 37 in such a way as to slip on a surface of the reversing roller 37 while being pressed against the reversing roller 37, the medium M is still smoothed, for example, even if the medium M is in a state of being contracted in the width-wise direction so as to be waved between the tension roller 35 and the reversing roller 37. Thus, causing a wrinkle at the time of winding-up operation is suppressed more certainly.

Figure 9:
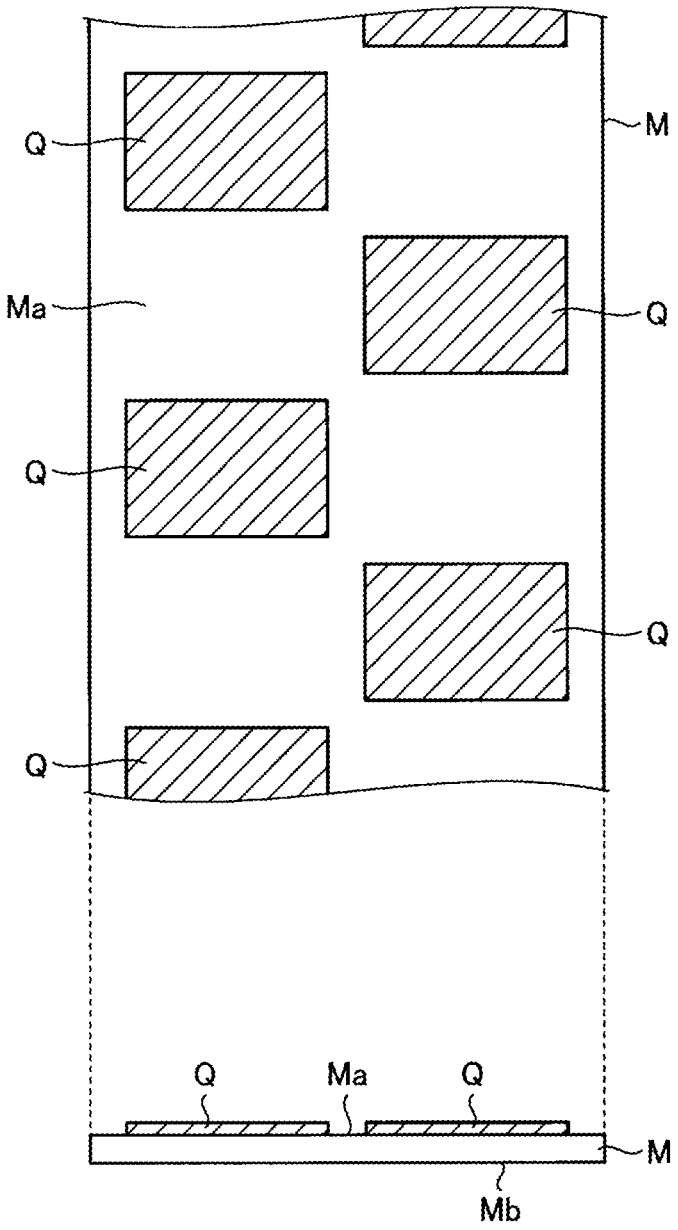
FIG. 9 is a diagram that shows an example of operation of creating an image by use of an image forming device of the printing machine according to the present embodiment.

FIG. 9 is a diagram that shows an example of operation of forming an image by use of the image forming device 20 of the printing machine 100 according to the present embodiment. If images are disproportionately created at one end side of the medium M in a width-wise direction in the image forming device 20, thickness at the one end side in the width-wise direction becomes thicker, owing to thickness of ink making up the images, being compared to thickness at the other side, at a time of winding up the medium M by the wind-up device 30, so that sometimes a wrinkle and the like is caused.

Then, the image forming device 20 may make an adjustment with respect to positions for creating images at a time of creating the images, as shown in FIG. 9, in such a way that the images are located evenly in the width-wise direction of the medium M in a state of having been wound up by the wind-up device 30. For example, after creating an image Q at one end side of the medium M in the width-wise direction, the image forming device 20 creates another image Q at the other side of the medium M in the width-wise direction. By way of repeating such an operation in a transfer direction of the medium M, the images are located evenly in the width-wise direction of the medium M in the state of having been wound up by the wind-up device 30, so that thickness of the medium M becomes even in the width-wise direction. Therefore, in combination with partitioning the distance, for which the tension is provided in the transfer direction of the medium M, by the reversing roller 37 mentioned above; causing a wrinkle can certainly be suppressed in the state where the medium M has been wound up.

As described above, the wind-up device 30 according to the present embodiment includes; the tension roller 35 that presses the medium M, which is belt-shaped and transferred in the predetermined transfer direction, in order to provide the medium M with a tension; the reversing roller 37 that reverses the medium M pressed by the tension roller 35, wherein the reversing roller 37 is rotatable so as to follow a move of the medium M; the brake pad 73 as the loading mechanism, which can place a load against a rotation of the reversing roller 37; the air supplier 74; the adjusting valve 75; and the wind-up roller 39 that winds up the medium M reversed by the reversing roller 37.

Meanwhile, the medium wind-up method according to the present disclosure includes: pressing the medium M, being belt-shaped and transferred in the predetermined transfer direction, by use of the tension roller 35, in order to provide the medium M with a tension; reversing the medium M, pressed by the tension roller 35, by use of the reversing roller 37, in a state where a load is placed against a rotation of the reversing roller 37 that is rotatable so as to follow a move of the medium M; and winding up the medium M reversed by the reversing roller 37.

Accordingly, by placement of the reversing roller 37 in the transfer path of the medium M from the tension roller 35 to the wind-up roller 39, the transfer path can be shortened. If the transfer path from the tension roller 35 to the wind-up roller 39 becomes long, a wrinkle is likely to be caused at a middle part of the medium M in the width-wise direction, even in the case of the same tension being provided. On the other hand, even though the reversing roller 37 is placed in the transfer path from the tension roller 35 to the wind-up roller 39; if the reversing roller 37 rotates while following the move of the medium M without having a load placed, a wrinkle is likely to be caused in the same manner at a middle part of the medium M in the width-wise direction. In the meantime, according to the present disclosure; a load can be placed against a rotation of the reversing roller 37 by the loading mechanism (including the brake pad 73, the air supplier 74, and the adjusting valve 75). By way of placement of a load against a rotation of the reversing roller 37, the load is placed for transferring the medium M so that causing a wrinkle is suppressed in advance. Moreover, a stronger tension can be provided to the medium M in such a way that the fluctuation of the winding position at the wind-up roller 39 can be suppressed.

In the wind-up device 30 according to the present embodiment, the loading mechanism including the brake pad 73, the air supplier 74, and the adjusting valve 75 may be able to stop a rotation of the reversing roller 37. According to this configuration, contraction of the medium M in the width-wise direction can more certainly be suppressed, and therefore causing a wrinkle can be suppressed.

In the wind-up device 30 according to the present embodiment, a surface of the reversing roller 37 for contacting the medium M may be made to be smooth by using a metal material. According to this configuration, while causing a wrinkle in the medium M is suppressed, the medium M can smoothly be transferred.

The wind-up device 30 according to the present embodiment may be provided with the upstream-side reversing roller 34 that reverses the medium M at an upstream side in the transfer direction in relation to the tension roller 35, in order to have a winding angle of the medium M to be wound around the tension roller 35, within a predetermined angle range. According to this configuration, the winding angle with respect to the tension roller 35 can be made within the predetermined angle range, between the upstream-side reversing roller 34 and the reversing roller 37, in such a way that complicating the transfer path of the medium M can be suppressed.

The printing machine 100 according to the present embodiment includes; the image forming device 20 that creates an image on the medium M, being belt-shaped and transferred in the predetermined transfer direction; and the wind-up device 30, described above, in order to wind up the medium M on which the image has been created.

Therefore, at a time of winding up the medium M after creating the image, causing a wrinkle can be suppressed, and the fluctuation of the winding position can be suppressed so that a high-quality printed material can be created.

In the printing machine 100 according to the present embodiment, the image forming device 20 may make an adjustment with respect to positions for creating images, in such a way that the images are located evenly in the width-wise direction being perpendicular to the transfer direction of the medium M, in a state of having been wound up by the wind-up device 30. According to this configuration, by making use of thickness of the images to be created on the medium M, it becomes possible to make the thickness of the medium M becomes even in the width-wise direction, in the state of the medium M having been wound up.

A technical scope of the present disclosure is not limited to the embodiment described above, and a change may appropriately be made without departing from an intent of the present disclosure.

What is claimed is:

1. A medium wind-up device, comprising:

a tension roller, configured to press a medium, which is belt-shaped and transferred in a transfer direction that is predetermined, in order to provide the medium with a tension;

a reversing roller, configured to reverse the medium pressed by the tension roller, and the reversing roller being rotatable so as to follow a move of the medium;

a loading mechanism, configured to place a load against a rotation of the reversing roller;

a wind-up portion, configured to wind up the medium reversed by the reversing roller; and a controller, configured to control the loading mechanism, wherein the controller controls a load applied to the medium by the loading mechanism according to a diameter of the medium wound by the wind-up portion.

2. The medium wind-up device according to claim 1, wherein the loading mechanism is configured to be able to stop a rotation of the reversing roller.

3. The medium wind-up device according to claim 2, wherein a surface of the reversing roller for contacting the medium is made to be smooth by using a metal material.

4. The medium wind-up device according to claim 3, further comprising:

an upstream-side reversing roller, configured to reverse the medium at an upstream side in the transfer direction in relation to the tension roller, in order to have a winding angle of the medium to be wound around the tension roller, within a predetermined angle range.

5. The medium wind-up device according to claim 2, further comprising:

an upstream-side reversing roller, configured to reverse the medium at an upstream side in the transfer direction in relation to the tension roller, in order to have a winding angle of the medium to be wound around the tension roller, within a predetermined angle range.

6. The medium wind-up device according to claim 1, wherein a surface of the reversing roller for contacting the medium is made to be smooth by using a metal material.

7. The medium wind-up device according to claim 6, further comprising:

an upstream-side reversing roller, configured to reverse the medium at an upstream side in the transfer direction in relation to the tension roller, in order to have a winding angle of the medium to be wound around the tension roller, within a predetermined angle range.

8. The medium wind-up device according to claim 1, further comprising:

an upstream-side reversing roller, configured to reverse the medium at an upstream side in the transfer direction in relation to the tension roller, in order to have a winding angle of the medium to be wound around the tension roller, within a predetermined angle range.

9. A printing machine, comprising:

an image forming device, configured to create an image on a medium, and being belt-shaped and transferred in a transfer direction that is predetermined; and the medium wind-up device according to claim 1, in order to wind up the medium on which the image has been created.

10. The printing machine according to claim 9, wherein the image forming device is configured to make an adjustment with respect to positions for creating the images, in such a way that the images are located evenly in a width-wise direction being perpendicular to the transfer direction of the medium, in a state of having been wound up by the medium wind-up device.

11. A medium wind-up method, comprising:

pressing a medium, which is belt-shaped and transferred in a transfer direction that is predetermined, by use of a tension roller, in order to provide the medium with a tension;

reversing the medium, which is pressed by the tension roller, by use of a reversing roller, in a state where a load is placed against a rotation of the reversing roller that is rotatable so as to follow a move of the medium;

winding up the medium reversed by the reversing roller; and controlling a load applied to the medium by the reversing roller according to a diameter of the medium which is wound.

12. A medium wind-up device, comprising:

a tension roller, configured to press a medium, which is belt-shaped and transferred in a transfer direction that is predetermined, in order to provide the medium with a tension;

a reversing roller, configured to reverse the medium pressed by the tension roller, and the reversing roller being rotatable so as to follow a move of the medium;

a loading mechanism, configured to place a load against a rotation of the reversing roller;

a wind-up portion, configured to wind up the medium reversed by the reversing roller; and a controller, configured to control the loading mechanism, wherein the controller causes the loading mechanism to stop the rotation of the reversing roller when a diameter of the medium wound by the wind-up portion becomes larger than a predetermined volume.

* * * * *